US006131990A

United States Patent [19]

Crean

[11] Patent Number: 6,131,990

[45] Date of Patent: Oct. 17, 2000

[54] TRAILER AWNING ASSEMBLY WITH DETACHABLE RUG

[75] Inventor: Johnnie Robert Crean, Chino, Calif.

[73] Assignee: Alfa Leisure, Inc., Chino, Calif.

[21] Appl. No.: 09/045,777

[22] Filed: Mar. 19, 1998

[51] Int. Cl.[7] ..... B60R 15/00

[52] U.S. Cl. ..... 296/163; 160/60; 160/66; 135/88.01; 135/88.11

[58] Field of Search ..... 296/163; 160/22, 160/23.1, 25, 45, 55, 60, 66, 26; 135/88.1, 88.11, 88.12, 88.01, 88.07

[56] References Cited

U.S. PATENT DOCUMENTS

| | | | |
|---|---|---|---|
| 2,788,791 | 4/1957 | Pospisil et al. | 135/88.07 |
| 3,902,752 | 9/1975 | Pelletier . | |
| 3,918,510 | 11/1975 | Hayward . | |
| 4,109,954 | 8/1978 | Wall . | |
| 4,175,576 | 11/1979 | Iby | 135/88.1 |
| 4,468,823 | 9/1984 | Tounjian . | |
| 4,719,954 | 1/1988 | Curtis et al. | 135/88.12 X |
| 4,729,594 | 3/1988 | Hoff . | |
| 4,867,502 | 9/1989 | Sylvester et al. . | |
| 5,100,716 | 3/1992 | Juneau . | |
| 5,199,120 | 4/1993 | Holmes . | |
| 5,358,298 | 10/1994 | Fate . | |
| 5,419,607 | 5/1995 | Oliveira . | |
| 5,529,825 | 6/1996 | Sutherland . | |
| 5,566,918 | 10/1996 | Becker . | |
| 5,718,253 | 2/1998 | McNamee | 135/88.1 X |

FOREIGN PATENT DOCUMENTS

4204640 A1 8/1993 Germany .

OTHER PUBLICATIONS

Carefree Today, Sidewinder II, vol. 8, Issue 1, p. 19, 1997.

*Primary Examiner*—Joseph D. Pape
*Attorney, Agent, or Firm*—Knobbe, Martens, Olson & Bear, LLP

[57] ABSTRACT

Disclosed is an awning assembly for a recreational vehicle. The awning assembly includes an awning that is configured to be extended from a sidewall of the recreational vehicle to provide shade. A rug is removably mounted to one edge of the awning. In use, the rug is removed from the awning and positioned on the ground below the awning to serve as a ground covering. When not being used, the rug is attached to the awning and stored with the awning in an awning housing to save space.

23 Claims, 8 Drawing Sheets

TRAILER AWNING ASSEMBLY WITH DETACHABLE RUG

BACKGROUND OF THE INVENTION

1. Field of the Invention

The invention relates to recreational vehicles. More particularly, the invention relates to an awning assembly for a recreational vehicle wherein the awning assembly includes a detachable rug that is adapted to be stored within a housing of the awning assembly.

2. Description of the Related Art

Recreational vehicles ("RVs") are large vehicles that arc equipped with many of the facilities of a home, such as a bedroom, a kitchen, and a family room. Travellers often take recreational vehicles on long trips and use the vehicles as lodging rather than staying in a hotel. Prior to leaving on a long trip, the traveller typically packs the vehicle to capacity with a sufficient amount of supplies, such as luggage and food, to last the entire trip. Consequently, the traveller must carefully plan which items will be taken on the trip, as storage space is limited.

During the trip, the recreational vehicle is typically parked in an RV park, where the recreational vehicle provides the traveller with a place to eat, sleep, and to generally relax. Travellers spend much of their time simply lounging and relaxing around the recreational vehicle and enjoying their vacation. While lounging as such, the traveller often extends an awning from the side of the vehicle to provide protection from the sun. During travel, the awning is adapted to be stored in a rollbar that is mounted to the side wall of the recreational vehicle. When the RV is parked, the traveller pulls the awning out of the rollbar so that the awning is stretched and suspended outward from the side of the vehicle. Typically, a pair of cantilevered arms extend outward from the side of the vehicle and are attached to the awning to keep the awning suspended. Oftentimes, the traveller will also attach a series of screens to the edges of the awnings. The screens hang downward toward the ground and thereby define a screened room beneath the awning that serves as a patio area which is more secure from dust and insects.

While the awning provides protection from the sun and the screens generally provide protection from wind and debris, the ground surface under the awning may be unpaved and dirty. Thus, it is often desirable to cover the ground beneath the awning with a rug or a carpet to cover any dust or debris and provide a generally clean and sanitary lounging area for the traveller. Without such a rug, dirt can be tracked into the RV which can be very difficult to clean up when on vacation. Unfortunately, there are a number of drawbacks associated with these rugs.

One such drawback relates to the large size of the rugs, which must be large enough to cover the area of the ground under the awning adjacent the door. Consequently, the rugs are bulky and cumbersome and thus use up a great deal of the limited storage space within the recreational vehicle when the rug is not being used. Hence, in order to bring along a rug on the trip, the traveller often has to leave behind other supplies that might otherwise be taken on the trip.

Moreover, these large rugs are also difficult to carry and maneuver, which makes it especially difficult to pack the rugs and to clean the rugs after use. Because the rugs are often laid over a dirty ground surface, the bottom surface of the rug tends to collect dirt and other debris during use which can be carried into the RV during storage of the rug.

One way of cleaning the rugs after use is to hang the rug and strike the rug till the debris falls to the ground. However, after the rug is cleaned, the traveller often drags the rug to the storage area which dirties the rug again. Hence, the rug is often stored in a dirty state, which increases the work of the traveller in keeping the RV clean during the trip.

There is therefore a need for a recreational vehicle rug that may be used in combination with an awning to provide a clean ground surface for the traveller to lounge and relax. Preferably, the rug should not take up much storage space within the recreational vehicle and should also be stored in a location where it does not use up storage space in the recreational vehicle nor require the rug to be carried into the recreational vehicle along with dirt and debris adhering to the rug. Furthermore, the rug should be large enough to cover a sufficient amount of ground surface yet still be easy to clean after use.

SUMMARY OF THE INVENTION

The aforementioned needs are satisfied by the present invention which relates to an awning assembly for a recreational vehicle. The awning assembly comprises an awning that is configured to be extended outward from the side of the recreational vehicle. A rug is adapted to be removably mounted to a suspended edge of the awning. A user may remove the rug from the awning and place the rug below the awning as a ground cover. After use, the rug is again attached to the awning and the rug and awning are both stored on a common roller to conserve space.

One aspect of the invention relates to an awning assembly for a recreational vehicle. The awning assembly comprises a spool or roller rotatably coupled to a recreational vehicle and a flexible awning having a first edge attached to the spool and a second edge opposed to the first edge. The awning is configured to be moved to an extended position wherein the first edge of the awning is attached to the spool and the second edge of the awning is suspended outward from the side wall of the recreational vehicle. The awning assembly further comprises a flexible rug having a first edge removably attached to the second edge of the awning. The awning and rug are configured to be rolled in series around the spool within the housing.

In another aspect of the invention, there is disclosed a recreational vehicle comprising a main body having a side wall and a wheel assembly supporting the main body. A rotatable spool is coupled to the side wall of the main body and an awning is adapted to be stored on the spool. The awning is also adapted to be extended from the awning housing so that an outboard edge of the awning is suspended outward from the side wall of the main body. A rug is removably attached to the outer end of the awning and is adapted to be stored on the spool with the awning. The rug is also adapted to be removed from the outer end of the awning and placed on the ground.

In yet another aspect of the invention, there is disclosed an awning assembly for a recreational vehicle. The awning assembly comprises a spool, an awning coupled to the spool and having a first end and a second end, and a rug removably coupled to the second end of the awning. The awning is configured to be moved to a storage state wherein the awning is rolled around the spool. The awning is also configured to be moved to an extended state wherein the first end of the awning is coupled to the spool and the second end is suspended outward from the housing. The rug is configured to be stored with the awning around the spool when the awning is in the storage state and is also configured to be suspended from the second end of the awning when the awning is in the extended state.

The awning assembly of the invention provides a number of advantages. For example, because the awning and rug are stored on a common roller or spool, the rug does not consume any additional storage space than would otherwise be consumed by the awning. Additionally, the rug does not have to be stored within the recreational vehicle so that the rug does not bring debris into the recreational vehicle after use. The rug is also easily cleaned after use by suspending the rug from the awning and striking the rug to remove dirt from the rug. These and other features of the present invention will become more fully apparent from the following description and appended claims taken in conjunction with the accompanying drawings.

BRIEF DESCRIPTION OF THE DRAWINGS

These and other features of the invention will now be described with reference to the drawings of a preferred embodiment, which are intended to illustrate and not to limit the invention and in which.

DETAILED DESCRIPTION OF THE PREFERRED EMBODIMENT

Figure 1:
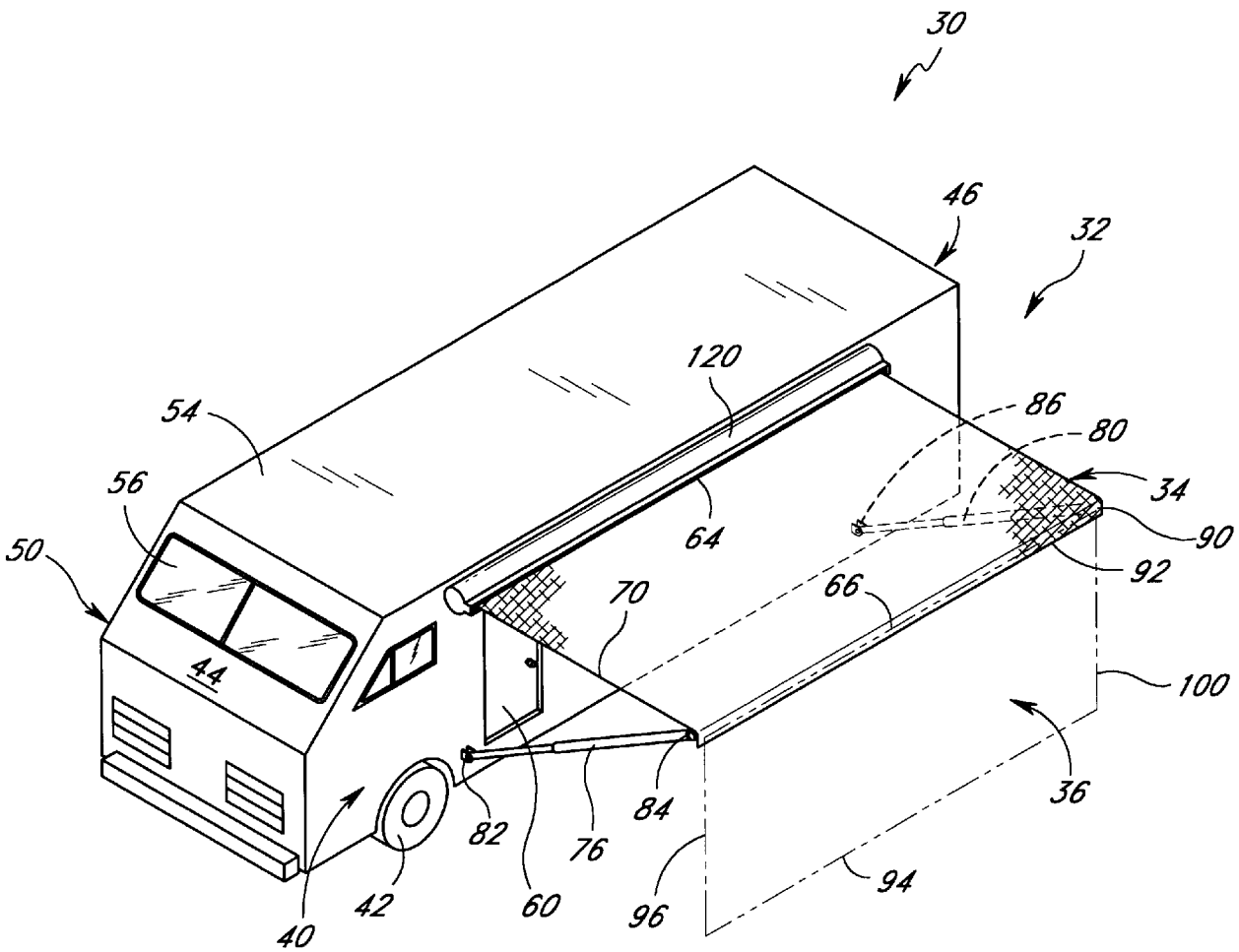
FIG. 1 is a perspective view of the awning assembly of the present invention mounted to a recreational vehicle.

FIG. 1 is a perspective view of a recreational vehicle 30 and an awning assembly 32 of the present invention mounted thereon. The awning assembly 32 includes an awning 34 for providing shade to an area adjacent the recreational vehicle 30. A rug 36 is removably mounted to an outboard edge 66 of the awning 34 so as to hang downward from the outboard edge 66 of the awning 34 when the awning 34 is extended in the manner shown in FIG. 1. The rug 36 is preferably configured to be removed from the awning 34 and positioned on the ground below the awning 34. When not being used, the awning 34 and rug 36 are adapted to be conveniently stored within a common storage space, as described more fully below.

With reference to FIG. 1, the recreational vehicle 30 generally comprises a body 40 mounted on a wheel assembly 42 in a well-known manner. The body 40 generally comprises a front wall 44 and an opposed rear wall 46. A pair of side walls 50, 52 are mounted between the front wall 44 and the rear wall 46. A roof or top wall 54 of the recreational vehicle 30 is mounted on top of the front wall 44, the rear wall 46, and the side walls 50 and 52. A plurality of windows 56 can be located on the body 40. Additionally, a door 60 is pivotably mounted on the side wall 52 of the recreational vehicle 30 in a well-known manner. It will be appreciated that the awning assembly 32 may be used with recreational vehicles of various shapes and sizes and is not limited to use with the type of recreational vehicle shown in FIG. 1. For example, the awning assembly 32 may be used with a trailer-type recreational vehicles that is towed behind a powered vehicle.

With reference to FIG. 1, the awning assembly 32 includes the substantially flat awning 34 which extends outward from an awning roller or spool 120 which is mounted on the side wall 52 of the recreational vehicle 30, as described in more detail below. In the illustrated embodiment, the awning 34 is substantially rectangular-shaped and defines an inboard edge 64 located at the spool 120 and an opposed outboard edge 66. The awning 34 further defines a pair of opposed side edges 70 and 72 that each extend substantially normal to the inboard and outboard edges 64 and 66. The awning 34 preferably comprises a substantially flat or planar piece of material that may be stretched out as shown in FIG. 1. Desirably, the awning 34 is manufactured of material that is flexible and that may be easily rolled and unrolled without being plastically deformed. Additionally, the awning 34 is desirably manufactured of material that is resistant to damage from inclement weather, such as rain or wind. For example, the awning 34 may be made from a nylon mesh material of a type commonly used for awnings in the prior art.

As shown in FIGS. 1 and 2A–2C, a first and a second support member 76 and 80, respectively, are mounted to the side wall 52 of the recreational vehicle 30 in a cantilevered fashion. The first and second support members 76 and 80 are attached to the outer end 66 of the awning 34 so as to support the awning 34 in the extended fashion shown in FIG. 1. The first support member 76 comprises an elongated rod or bar having a first end 82 that is pivotably mounted to the side wall 52 of the recreational vehicle 30, as described more fully below. A second end 84 of the first support member 76 is removably mounted to the awning 34 to support the awning 34 in a stretched-out or suspended state. Preferably, the second end 84 of the first support member 76 is mounted to the corner of the awning 34 where the side edge 70 meets the outboard edge 66 of the awning 34.

Similarly, the second support member 80 comprises an elongated rod or bar having a first end 86 pivotably mounted to the side wall 52 of the recreational vehicle 30, as described more fully below. The second support member 80 also has a second end 90 that is removably attached to the awning 34 to further support the awning 34 in the stretched-out or suspended state. Preferably, the second support member 80 is mounted to the corner of the awning 34 where the side edge 72 meets the outboard edge 66 of the awning 34. It will be appreciated that other support structures could also be used to provide support to the awning 34. For example, a pair of rigid rods could be mounted along the side edges 70 and 72 of the awning 34.

As shown in FIG. 1, the awning assembly 32 further comprises a carpet or rug 36 that is removably mounted to the outboard edge 66 of the awning 34 so as to hang downward in the manner shown in FIG. 1 when the awning 34 is extended. For illustrative purposes, the rug 36 is shown using phantom lines. In the illustrated embodiment, the rug 36 is rectangular-shaped and defines a first edge 92 and an opposed second edge 94 that extends substantially parallel to the first edge 92. The rug 36 further defines a pair of opposed side edges 96, 100 that extend substantially normal to the first edge 92 and the second edge 94. In this embodiment, the distance between the side edges 96 and 100 of the rug is less than or equal to the distance between the side edges 70 and 72 of the awning. The rug 36 comprises a flat or planar piece of material of the type that is commonly used for rugs or floor coverings. Additionally, the rug 36 is preferably made of a flexible material that may be rolled and unrolled without being plastically deformed, and which is highly resistant to damage from water and dirt and from being stepped-on.

Figure 2A:
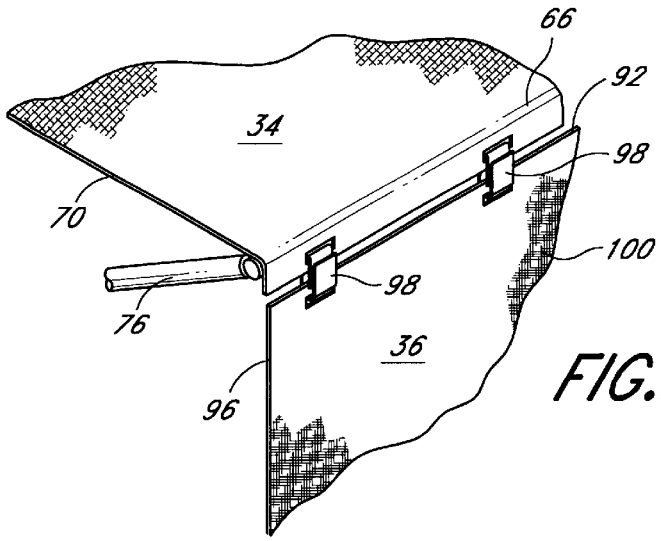
FIGS. 2A–2C are enlarged perspective view of a portion of an awning and rug of the awning assembly shown in FIG. 1.

As shown on FIG. 1, the rug 36 is adapted to be suspended from the outboard edge 66 of the awning 34. Specifically, the first edge 92 of the rug 36 is aligned parallel with and removably attached to the outboard edge 66 of the awning 34 using suitable attachment means. FIG. 2A is an enlarged perspective view of the interface between the awning 34 and the rug 36. A plurality of fasteners 98 extend across the awning 34 and the rug 36 where the outboard edge 66 of the awning 34 meets the first edge 92 of the rug 36. The fasteners 98 removably fasten the outboard edge 66 of awning 34 to the first edge 92 of the rug 36. In the embodiment shown in FIG. 2A, the fasteners 98 comprise complementary strips of hook and loop fastening material, such as VELCRO™, which are removably coupled to one another.

Figure 2B:
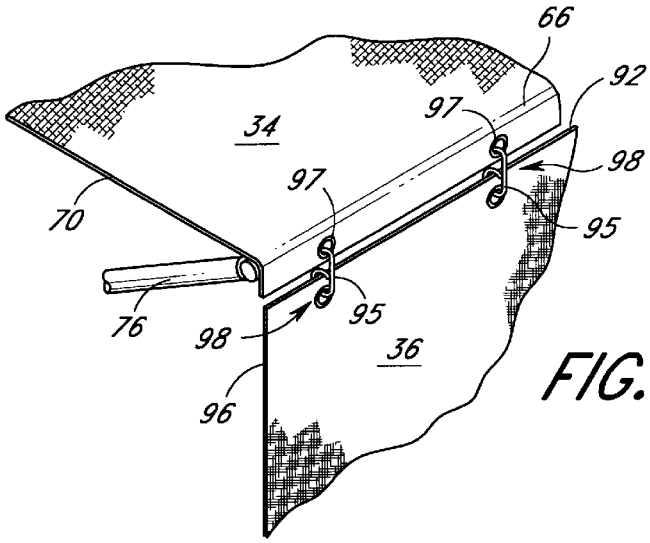
Figure 2C:
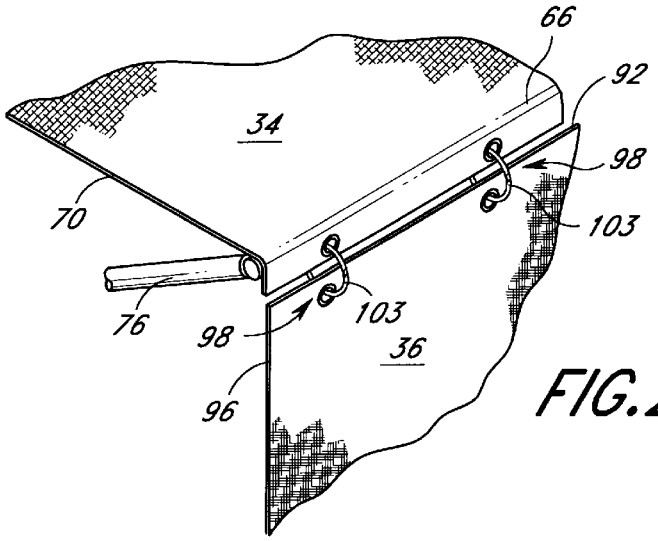

In another embodiment shown in FIG. 2B, the fasteners 98 comprise a plurality of hooks 95 that are attached to the first edge 92 of the rug 36. The hooks 95 are adapted to mate with a corresponding plurality of holes 97 that are positioned adjacent the outboard edge 66 of the awning 34. In yet another embodiment shown in FIG. 2C, the fasteners 98 comprise clamps 103 that are attached to the first edge 92 of the rug 36 and removably clamp onto holes 97 on the outboard edge 66 of the awning 34. It will be appreciated that any of a wide variety of other fastening devices could also be used to removably fasten the rug 36 to the awning 34 and that the fastening devices could be attached to either the rug 36 or the awning 34. As discussed more fully below, a user may easily remove the rug 36 from the awning 34 by removing the fasteners 98 from engagement with the awning 34 or the rug 36.

Figure 3:
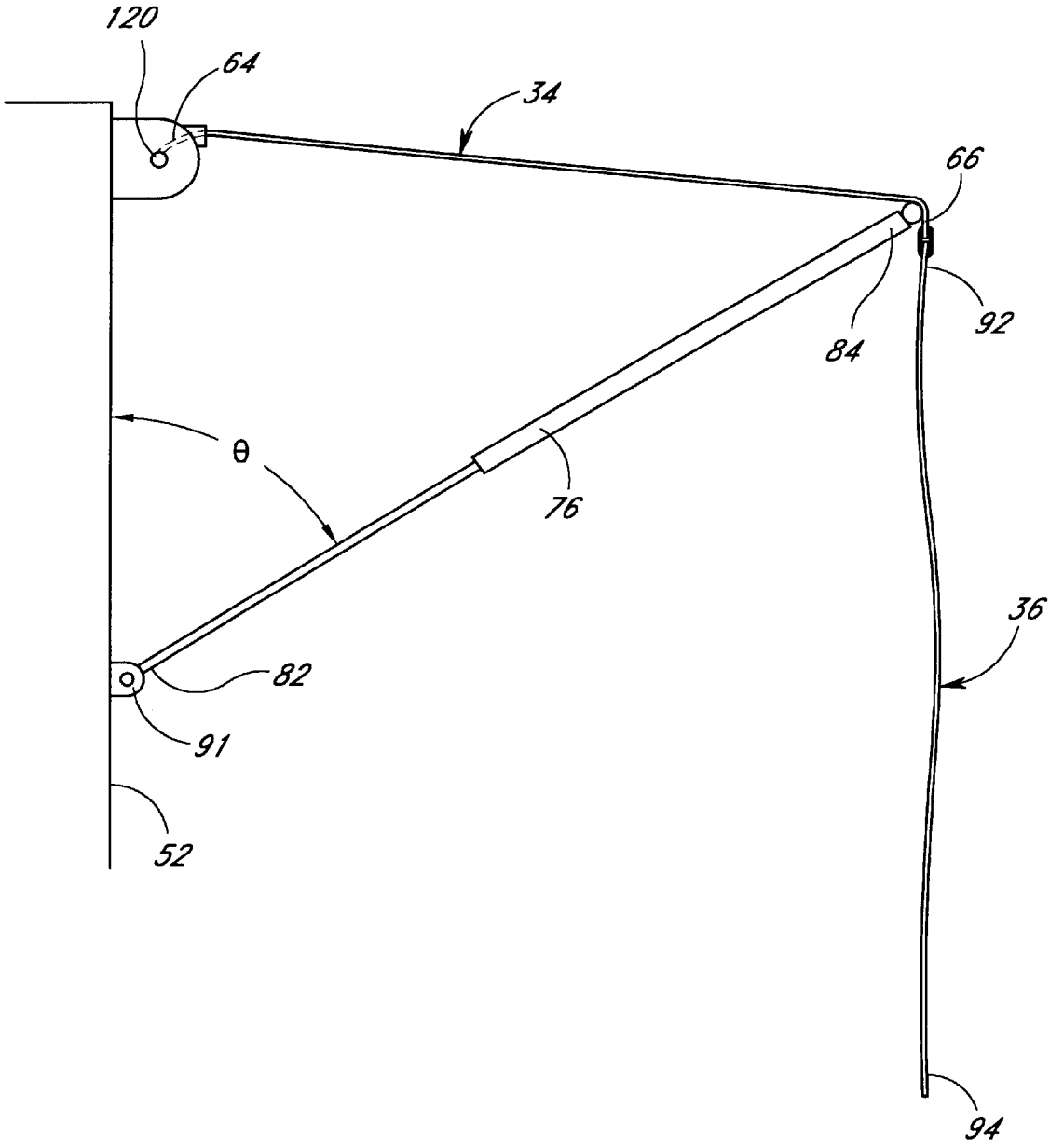
FIG. 3 is a side view of the awning assembly of the present invention in an extended state.

FIG. 3 is a side view of the awning assembly 32 shown in FIG. 1. In FIGS. 1 and 3, the awning assembly 32 is shown in an "extended" state in which the awning 34 is stretched outward and suspended from the side wall 52 of the recreational vehicle 30. That is, the inboard edge 64 of the awning 34 is positioned at the spool 120 and the outboard edge 66 is stretched outward from the side wall 52 of the recreational vehicle 30. Additionally, the spool 120 in the illustrated embodiment is positioned within an optional housing 62, as described in more detail below. When the awning assembly 32 is in the extended state, the first and second support members 76 and 80 extend at an angle θ relative to the side wall 52 of the recreational vehicle 30 to thereby support the awning 34 in the extended state. The first end 82 of the first support member 76 is preferably pivotably attached to a pivot mount 91 on the side wall 52 so that the first support member 76 may pivot around the first end 82 throughout the angle θ. The second support member 80 is attached to the side wall 52 of the recreational vehicle 30 in an identical manner.

Figure 4:
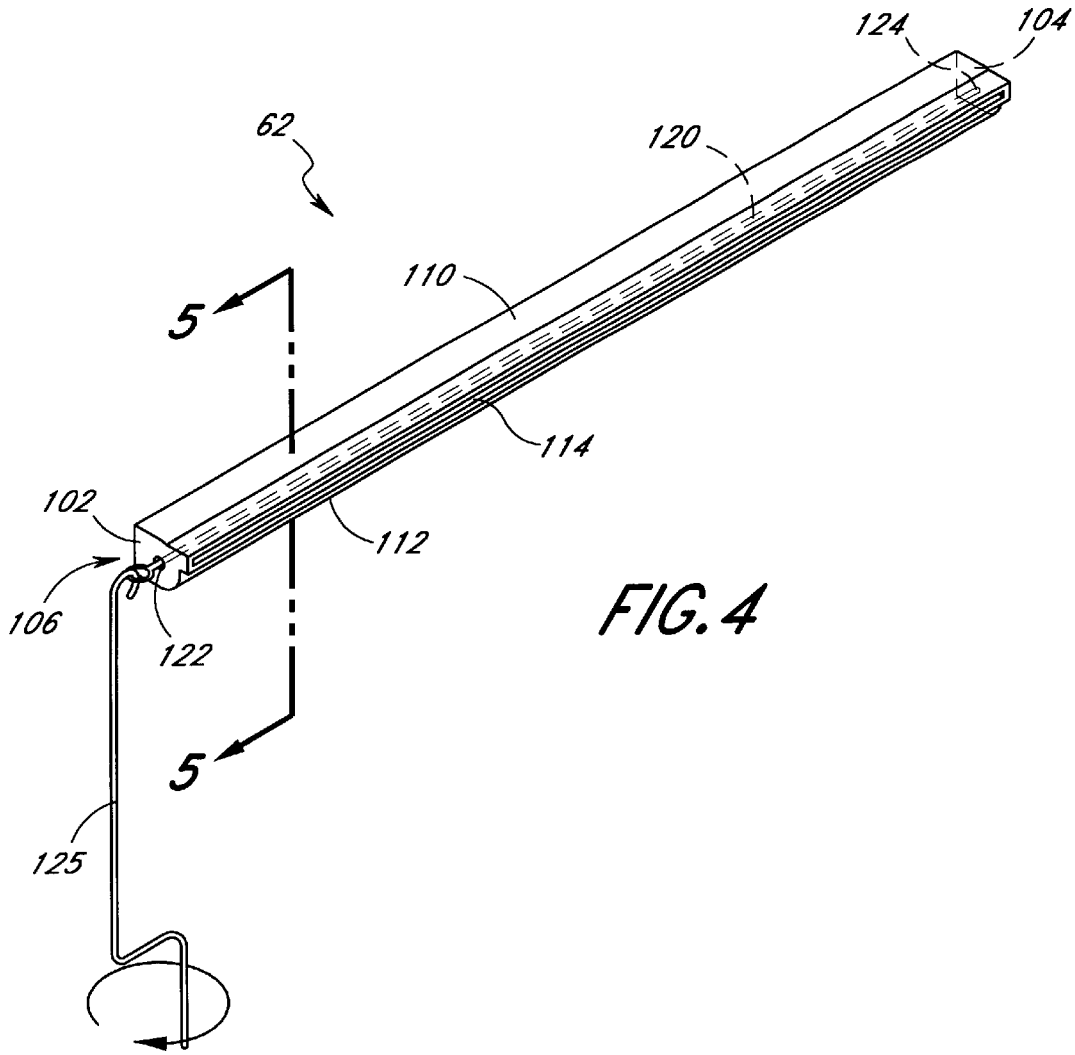
FIG. 4 is a perspective view of a storage housing of the awning assembly of the present invention.

FIG. 4 is an enlarged view of the awning housing 62 in which the awning 34 and the rug 36 may be stored when not in use. The awning housing 62 is elongated and includes a pair of opposed side walls 102 and 104. The awning housing 62 also includes a rear wall 106 that is adapted to be mounted to the side wall 52 of the recreational vehicle 30. The awning housing 62 further includes an upper wall 110 and a lower wall 112 that are positioned between the side walls 102 and 104 of the awning housing 62. The upper wall 110 and the lower wall 112 of the awning housing 62 are spaced slightly apart so as to define an elongated opening 114 therebetween. The elongated opening 114 provides a passageway for the awning 34 and the rug 36 to be slid into or out of the awning housing 62, as described in more detail below.

With reference to FIG. 4, the spool 120 (shown in phantom) is journaled within the awning housing 62. The spool 120 has a first end 122 rotatably mounted to the side wall 102 of the awning housing 62 and a second end 124 rotatably mounted to the side wall 104 of the awning housing 62. A hook 123 extends outward from the first end 122 of the spool 120 so as to protrude through the side wall 102 of the housing 62. An arm 125 is sized to mate with the hook 123. The arm 125 may be attached to the hook 123 and be used to rotate the spool 120, as described more fully below. The spool 120 may also be spring mounted to the side walls 102 and 104 in a well known manner so that the spool 120 recoils in one rotational direction in response to being quickly rotated in the opposite direction.

Figure 5:
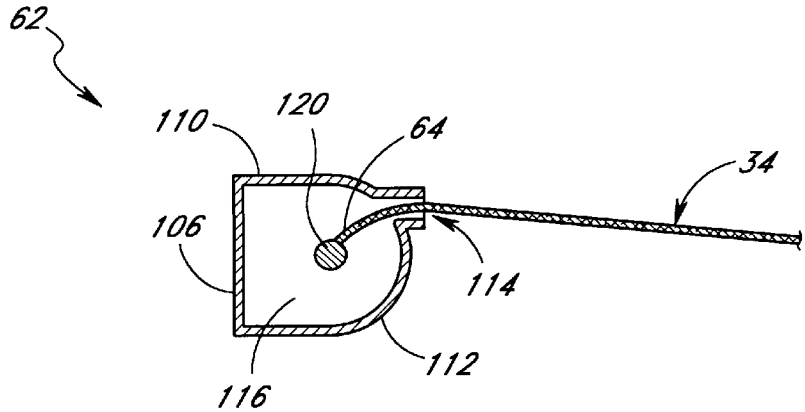
FIG. 5 is a cross-sectional view of the housing of FIG. 4 taken along line 5—5.

FIG. 5 is a cross-sectional view of the awning housing 62 along line 5—5 of FIG. 4. The cross-section of the awning housing 62 is rectangular or circular-shaped so that the awning housing 62 defines a storage space 116 therein. Desirably, the storage space 116 comprises a volume that is large enough to receive the awning 34 and the rug 36 in a non-extended state wherein the awning 34 and the rug 36 are coiled or wrapped around the spool 120, as described more fully below. The inboard end 64 of the awning 34 is attached to the spool 120 in a well-known manner.

The awning housing 62 may be attached to the side wall 52 of the recreational vehicle 30 using any suitable attachment means, such as, for example, screws, nuts and bolts, welding, etc. Alternatively, the awning housing may be integrally formed with the side wall 52 of the recreational vehicle 30. It is also contemplated that the awning housing 62 may be housed within the side wall 52. In such a case, an elongated opening preferably extends through the side wall 52 so as to communicate with the storage cavity 116 of the awning housing 62. It will be appreciated that the housing 62 is not required. That is, the spool 120 could be mounted on the recreational vehicle without the use of the housing 62. However, the housing 62 provides protection to the awning 34 and the rug 36 when they are being stored.

Figure 6:
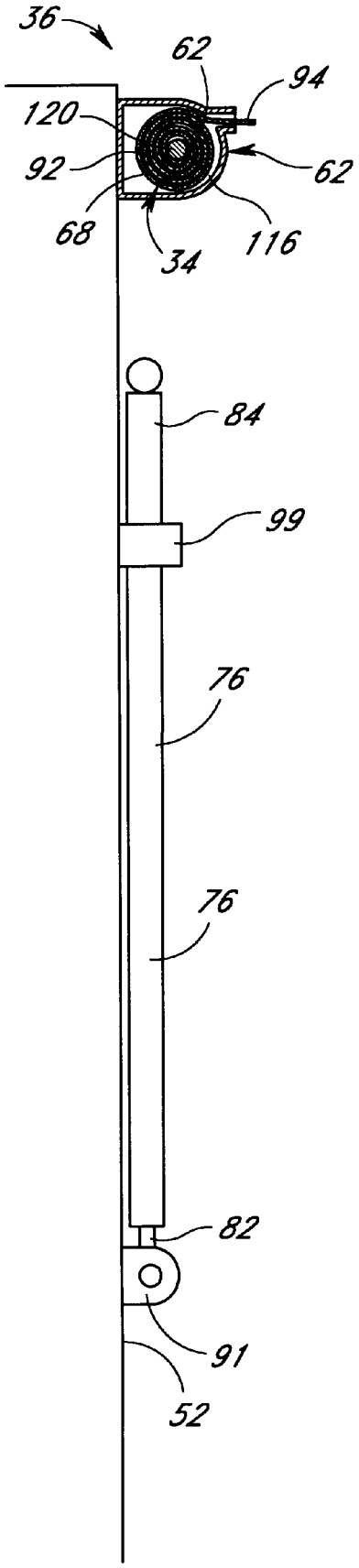
FIG. 6 is a side view of the awning assembly of the present invention in a rolled state.

With reference to FIG. 6, the awning assembly 32 is configured to be moved to a non-extended or storage state wherein the awning 34 and rug 36 are both stored within the awning housing 62. In the non-extended state, both the awning 34 and the rug 36 are wound in series around the spool 120 with the outboard edge 66 of the awning 34 attached to the first edge 92 of the rug 36. Preferably, the second edge 94 of the rug 36 protrudes slightly from the elongated opening 114 of the awning housing 62 when the awning 34 and rug 36 are in the non-extended state. Additionally, the second edge 94 of the rug 36 preferably has a thickness that does not fit through the elongated opening 114 to inhibit the second edge 94 from sliding entirely into the awning housing 62.

The awning assembly 32 is preferably moved from the extended state (FIG. 3) to the non-extended state (FIG. 6) by rotating the spool 122 using the arm 125 (FIG. 4). Alternately, if the spool 122 is spring mounted, the awning assembly may be moved to the non-extended state by quickly tugging on the second edge 94 of the rug 36 so that the spool 120 quickly rotates in a first rotational direction.

As mentioned, the spring mounting causes the spool to recoil in the opposite rotational direction in response to such action. The rotation of the spool 120, which is attached to the awning 34, pulls the awning 34 into the storage cavity 116 through the elongated opening 114 so that the awning 34 winds around the spool 120. The awning 34 in turn draws the attached rug 36 into the storage cavity 116 until the awning 34 and rug 36 are fully wound in series around the spool 120. A user may return the awning assembly 32 to the extended state by pulling on the protruding second edge 94 of the rug 36.

Preferably, the first and second support members 76 and 80 are disengaged from the awning 34 prior to winding the awning 34 and rug 36 into the awning housing 62. As mentioned, the first and second support members 76 are configured to pivot about their respective mounts 91 and to be positioned directly adjacent the side wall 52 of the recreational vehicle 30, as shown in FIG. 6. Preferably, at least one attachment member 99, such as a clamp, is located on the side wall 52 for fixing the position of the first and second support members 76 and 78 against the side wall 52 when not in use. The first and second support members 76 and 78 may be configured to telescope in size to reduce their sizes when not in use.

The awning assembly 32 is preferably used when the recreational vehicle 30 is at a stand-still, such as when the recreational vehicle 30 is parked in an RV park. Preferably, the awning assembly 32 is in the non-extended or rolled state when the recreational vehicle 30 is moving. Once the recreational vehicle 34 is parked in a suitable location, a user rotates the spool 122 using the arm 125 so that the awning 34 and rug 36 slide out of the awning housing 62 through the elongated opening 124. Alternately, a user may pull on the protruding second edge 94 of the rug 36 to thereby slide the rug 36 out of the awning housing 62 through the elongated opening 114. As the rug 36 slides out of the awning housing 62, the first edge 92 of the rug 36 draws the attached awning 34 out of the awning housing 62. Desirably, the rug 36 and awning 34 are fully slid out of the awning housing and the first and second support members 67 and 80 are then used to support the awning assembly 32 in the extended state, as shown in FIG. 1.

Figure 7:
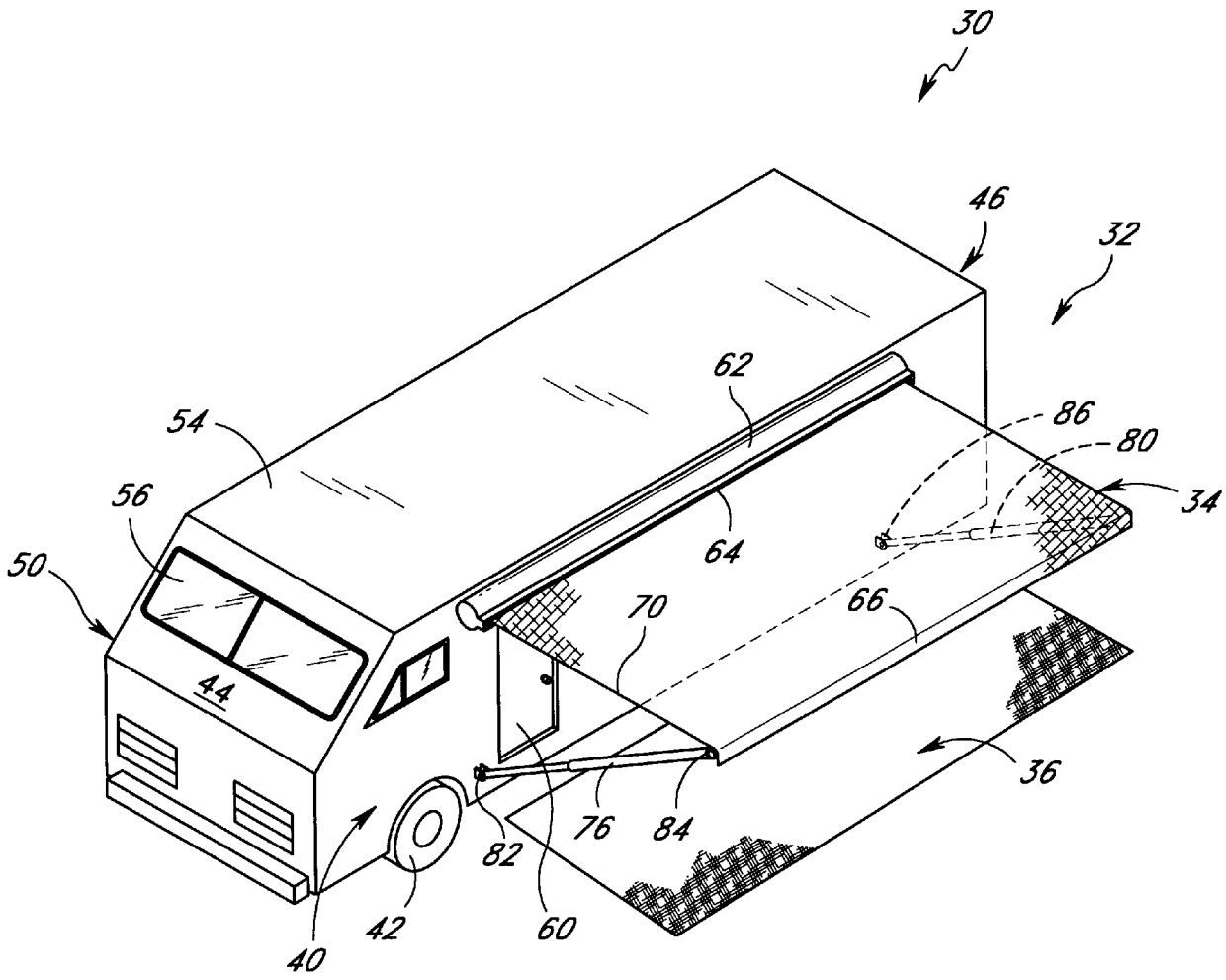
FIG. 7 is a perspective view of a recreational vehicle in which a rug is positioned on a ground surface below an extended awning.

The user then removes the rug 36 from the awning 34 by disengaging the fasteners 98. Preferably, the rug 36 is then placed on the ground below the awning, as shown in FIG. 7. The rug 36 functions as a ground cover for the area below the awning 34. When the user is ready to move the recreational vehicle, the rug 36 is again suspended from the outboard end 66 of the awning 34. The user may then remove any dirt or debris from the rug 36 while the rug 36 is hanging from the awning 34, such as by striking or wiping the rug 36. The hanging orientation of the rug 36 advantageously makes it easy for a user to clean the rug 36.

After the rug 36 has been attached to the awning 34, the user moves the awning assembly 32 to the rolled or non-extended state in which the awning 34 and rug 36 are stored within the awning housing 62. As mentioned, the user may use the arm 125 to rotate the spool 122 and pull the awning 34 and rug 36 into the awning housing 62. Alternately, if the spool 122 is spring mounted, the user may quickly tug the rug 36 or awning 34 slightly outward relative to the awning housing 62 to activate the spring-loaded spool 120 and cause the spool 120 to pull the awning 34 and the attached rug 36 into the awning housing 62. The rug 36 and awning 34 are conveniently both stored within the same awning housing 62 during non-use.

Figure 8A:
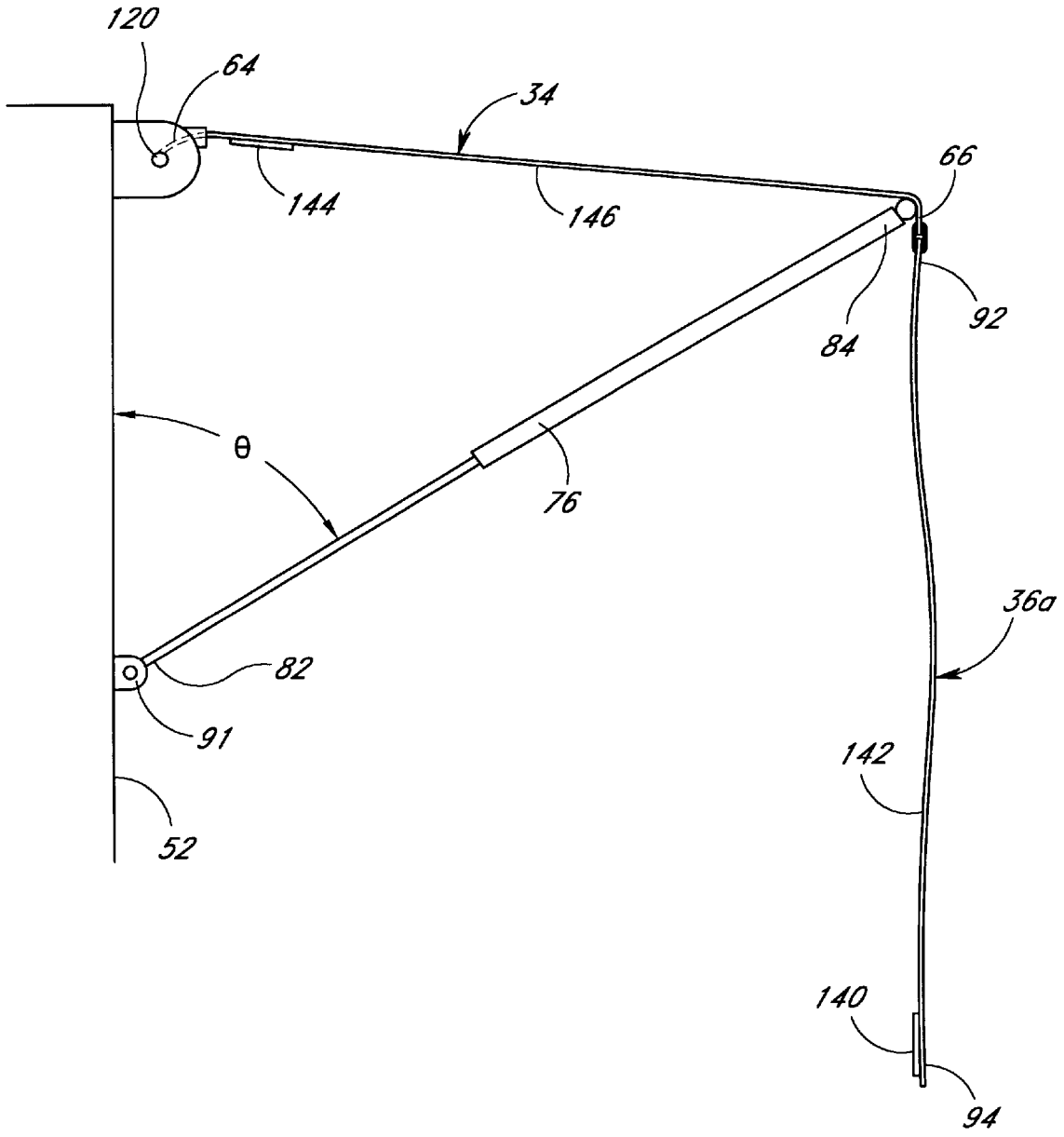
FIGS. 8A and 8B are side views of an alternative embodiment of the awning assembly of the present invention.
Figure 8B:
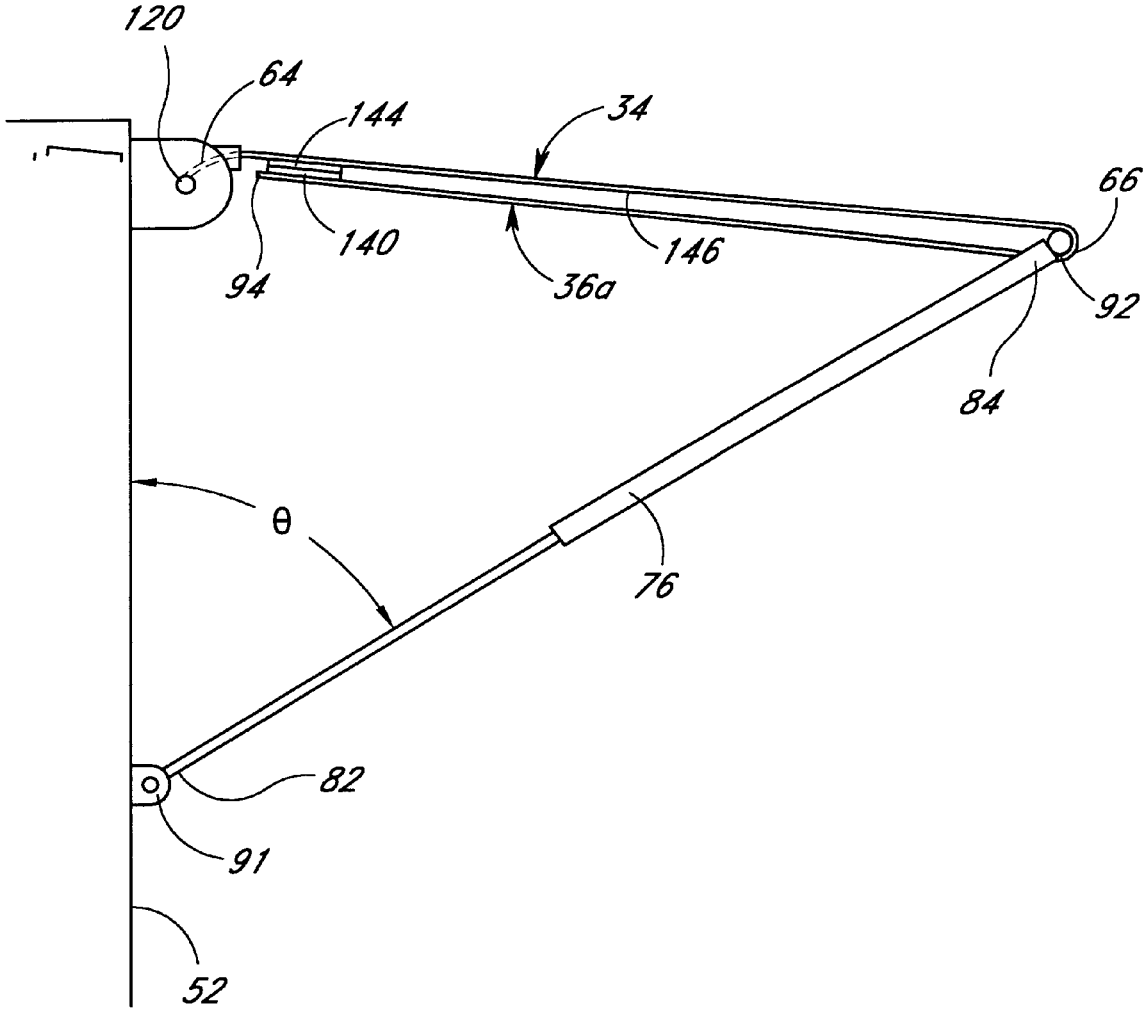

FIG. 8A shows an alternative embodiment of the awning assembly 32 which includes a rug 36*a*. An additional fastener 140 is positioned on an inner surface 142 of the rug 36*a*, preferably near the second edge 94. A corresponding fastener 144 is positioned on an inner surface 146 of the awning 34, preferably near the inboard edge 64 of the awning 34. In one embodiment, the fasteners 140 and 144 each comprise hook and loop material. With reference to FIG. 8B, the inner surface 142 of the rug 36 is positioned adjacent the inner surface 146 of the awning 34 so that the fastener 140 mates with the fastener 144 to thereby secure the rug 36 against the awning 34. The second end 94 of the rug 36 and inboard end 64 of the awning 34 may then be simultaneously rolled into the housing 62 until the outboard edge 66 of the awning 34 and the first edge 92 of the rug 36a protrude outward from the housing 62. In this manner, the rug 36*a* and awning 34 are rolled in "parallel" around the spool 120 and within the housing 62. When the awning 34 and rug 36 are stored in parallel, the likelihood of the awning 36 and rug 34 becoming pulled apart while unwinding the spool is greatly reduced.

The awning assembly 30 advantageously allows a traveller to bring the rug 36 on a trip and also conserve space within the recreational vehicle 30. Because the awning 34 and rug 36 are stored in a common awning housing 62, the rug 36 does not use any additional space than would otherwise be used for the awning 34. Advantageously, when the awning assembly 32 is moved to the extended state, the rug 36 is conveniently positioned near the area where it will likely be used. After use, the user simply hangs the rug 36 from the awning 34 where the rug may be easily cleaned. The user then simply winds the rug 36 and awning 34 into the awning housing 62 so that no additional dirt or debris is accumulated on the rug 36.

Although the foregoing description of the invention has shown, described and pointed out fundamental novel features of the invention, it will be understood that various omissions, substitutions, and changes in the form of the detail of the apparatus and method as illustrated and described, as well as the uses thereof, may be made by those skilled in the art without departing from the spirit of the present invention. Consequently, the scope of the invention should not be limited to the foregoing discussion, but should be defined by the appended claims.

What is claimed is:

1. An awning assembly for a recreational vehicle, comprising:

a spool coupled to the recreational vehicle;

a flexible awning having a first edge attached to the spool and a second edge opposed to the first edge, wherein the awning can be moved between a retracted position wherein the flexible awning is rolled about the spool and an extended position wherein the first edge of the awning is attached to the spool and the second edge of the awning is suspended outward from the recreational vehicle, and a flexible rug having a first edge removably attached to the second edge of the awning;

wherein the awning and the rug are rolled around the spool within the housing in the retracted position.

2. The awning assembly of claim 1, additionally comprising a housing coupled to a side wall of the recreational vehicle, wherein the spool is rotatably mounted within the housing.

3. The awning assembly of claim 1, wherein the awning and rug are configured to be rolled in series around the spool within the housing.

4. The awning assembly of claim 2, wherein the housing includes an elongated aperture, and wherein the awning protrudes through the elongated aperture when the awning is in the extended position.

5. The awning assembly of claim 1, additionally comprising at least one attachment device at an interface between the second edge of the awning and the first edge of the rug for attaching the rug to the awning.

6. The awning assembly of claim 5, wherein the at least one attachment device comprises a set of clamps configured to clamp the rug to the awning.

7. The awning assembly of claim 5, wherein the at least one attachment device comprises hook and loop fastening material.

8. the awning assembly of claim 1, additionally comprising a pair of a support members removably attached to the awning, the support members configured to support the awning in the extended position.

9. The awning assembly of claim 8, wherein the support members comprise rigid, elongated rods having a first end configured to be attached to the side wall of the housing and a second end configured to be attached to the second end of the rug.

10. The awning assembly of claim 1, wherein the rug has a second edge configured to be removably attached to a portion of the awning.

11. A recreational vehicle, comprising:

a main body having a side wall;

a wheel assembly supporting the main body;

a spool rotatably coupled to the main body;

an awning wherein the awning is wound around the spool in a storage configuration, and wherein the awning is movable between the storage configuration and a deployed configuration wherein the awning is extended from the spool so that an outboard edge of the awning is suspended outward from the side wall of the main body; and a rug removably attached to the outboard end of the awning, wherein the rug is wound around the spool with the awning when the awning is in the storage configuration, and wherein the rug can be removed from the outboard end of the awning and placed on the ground when the awning is in the deployed configuration.

12. The recreational vehicle of claim 11, wherein the spool is contained within a housing coupled to the side wall of the main body.

13. The recreational vehicle of claim 11, wherein the awning and rug are adapted to be wound in series around the spool.

14. The recreational vehicle of claim 11, wherein the awning and rug are adapted to be wound in parallel around the spool.

15. The recreational vehicle of claim 13, wherein the rug has a first end removably attached to the outboard end of the awning so that the awning and rug may be rolled in series around the spool within the awning housing.

16. The recreational vehicle of claim 15, additionally comprising at least one attachment device for attaching the first end of the rug to the outboard end of the awning.

17. The recreational vehicle of claim 16, wherein the at least one attachment device comprises a set of hooks.

18. The recreational vehicle of claim 14, wherein the at least one attachment device comprises a set of clamps.

19. The recreational vehicle of claim 11, wherein the awning and rug are adapted to be wound in parallel around the spool.

20. An awning assembly for a recreational vehicle comprising:

a spool;

an awning coupled to the spool, the awning having a first end and a second end wherein the awning is movable between a storage state wherein the awning is rolled around the spool, and an extended state wherein the first end of the awning is coupled to the spool and the second end is suspended outward from the spool; and a rug removably coupled to the awning, wherein the rug is rolled with the awning around the spool when the awning is in the storage state, and wherein the rug is suspended from the awning when the awning is in the extended state.

21. The awning assembly of claim 20, wherein the awning and the rug are wrapped in series around the spool when the awning is in the storage state.

22. The awning assembly of claim 20, wherein the awning and the rug are wrapped in parallel around the spool when the awning is in the storage state.

23. The awning assembly of claim 20, wherein the rug is removably attached to the second end of the awning.

* * * * *